US005895299A

United States Patent [19]

Hyde

[11] Patent Number: 5,895,299

[45] Date of Patent: Apr. 20, 1999

[54] LIFESAVING DEVICE

[76] Inventor: Robert W. Hyde, 9340 W. Putter Ct., Crystal River, Fla. 34429

[21] Appl. No.: 08/619,256

[22] Filed: Mar. 18, 1996

[51] Int. Cl.[6] ..... B63C 9/26

[52] U.S. Cl. ..... 441/84; 242/405

[58] Field of Search ..... 446/46, 48; 441/80, 441/81, 84, 85, 133, 136; 242/398, 400, 405, 405.1; 472/588; D21/85, 86

[56] References Cited

U.S. PATENT DOCUMENTS

| | | | |
|---|---|---|---|
| 3,935,663 | 2/1976 | Leibowitz | 446/48 |
| 4,302,901 | 12/1981 | Psyras | 446/46 |
| 4,979,922 | 12/1990 | Clark | 446/46 |
| 5,433,637 | 7/1995 | Graves | 441/80 |
| 5,562,512 | 10/1996 | Samelian | 441/81 |

FOREIGN PATENT DOCUMENTS

| | | | |
|---|---|---|---|
| 1225545 | 8/1987 | Canada | 441/84 |
| WO 94/05542 | 3/1994 | WIPO | 441/81 |

*Primary Examiner*—Edwin L. Swinehart

[57] ABSTRACT

A life saving disc adapted to be thrown with considerable accuracy to a person in distress. The disc is provided with peripherally arranged flanges for retaining a length of line as well as floatation rendering the disc buoyant in water. In use, line is retained by the user at one end, such that when the disc is thrown to a person in distress, the line is dispensed from the disc. The person in distress grasping the disc, can then be pulled to safety.

2 Claims, 1 Drawing Sheet

LIFESAVING DEVICE

This invention relates to hand thrown flying discs.

The flying disc is a well established sport device. It is thrown back and forth between people, thrown into or at targets, and even used in a game called Frisbee® Golf.

My invention uses the aerodynamics of the flying disc and includes flanges for holding a length of rope or line around a pulley-like perifery. This rope or line unwinds as the disc progresses on it's flight. My disc can also be double sided, sealed to provide several pounds of floatation, and provides periferal flanges to retain the rope or cord.

The main purpose of this invention is to provide boats and beaches with a simple easily thrown life saving device trailing a rope or line with which the person being rescued can be pulled back to the boat or land. This invention makes it possible to quickly rescue persons who have fallen from a boat, swam too far out, or are in trouble in the water. The device may be larger than normal flying discs now in production. It provides floatation, the rope, and the aerodynamics to be thrown a considerable distance. The rope end is affixed to the disc and the launching end is provided with a strap and loop for the thrower to retain the end of the rope.

There are other uses for this device which trails a rope or cord. It can convey a connecting rope between vessels, over chasms, between buildings, or where a rope or line needs to be thrown.

Another use is to provide fishermen with a device which trails out a recovery line, can have a drop line for live or other bait, be thrown a considerable distance, float, and provide resistance to hook the fish. A fisherman can have several of these in the water at the same time greatly increasing his chances of hooking fish. No rod or reel is needed.

The construction of my device is different from conventional flying discs. My device may be comprised of two different discs, formed to be sealed together or made by a process that will provide both sides and the sealed air chamber. The drawings show the present configuration with the two parts sealed together. The upper unit is formed to a dome shape to provide the aerodynamics needed to maintain flight. This also has an outer shape which forms the upper flange of the rope retaining groove. The bottom disc interlocks with the upper disc and is cemented to it provided an air tight chamber for the floatation. This part also provides the lower flange of the rope retaining groove.

Sufficient rope of a desirable strength is wound into the rope retaining groove to cover the desired distance. The inner end of the rope is fastened to the disc assembly. The outer end of the rope is attached to the hand hold loop. When the disc is thrown, it spins and the rope unwinds as the disc flies. Any rope still on the disc when it lands on the water is easily pulled off. When used as a life saver, the person being rescued grasps the disc and is pulled back to the boat or land. The rope can be rewound by hand and the disc is ready for another use.

The fishing version is different in construction. This unit is comprised of three parts cemented together. The upper part is similar to the top part of the life saving disc in shape and provides the upper flange to retain the cord. The bottom has two parts. The center part is a tubelike unit having a slight flange at the bottom onto which the drop line is tied and wound. The outer part of the bottom piece provides the lower flange for the line, the floatation chamber, and a retainer flange to hold the bait. The inner flange faces inward and downward such that centrifugal force due to the spinning holds the bait in place until the disc hits the water and the spinning stops. The bait then drops into the water and the dropline unreels from the inner spool. The disc floats and becomes the bobber. A fisherman can have several out surrounding the boat or along the shore. The handle end can be looped over something in the boat or a peg on the beach. The drawings show both units and the preferred construction of each. Other means of construction are practical, but the drawings show the present design.

REFERENCE NUMERALS IN DRAWINGS

#1 Refers to the top of both discs.
#2 Refers to the upper flange of both discs.
#3 Refers to the lower flange of both discs.
#4 Refers to the bottom of the upper disc
#5 Refers to the seal points of both discs.
#6 Refers to the sealed air space in both discs.
#7 Refers to the rope or twine in both discs.
#8 Refers to the finger grip space in both discs.
#9 Refers to the inner flange on the lower disc section.
#10 Refers to the inner spool on which the fishing drop line is wound.

DESCRIPTIONS OF FIGS. 1 THROUGH 4

Figure 1:
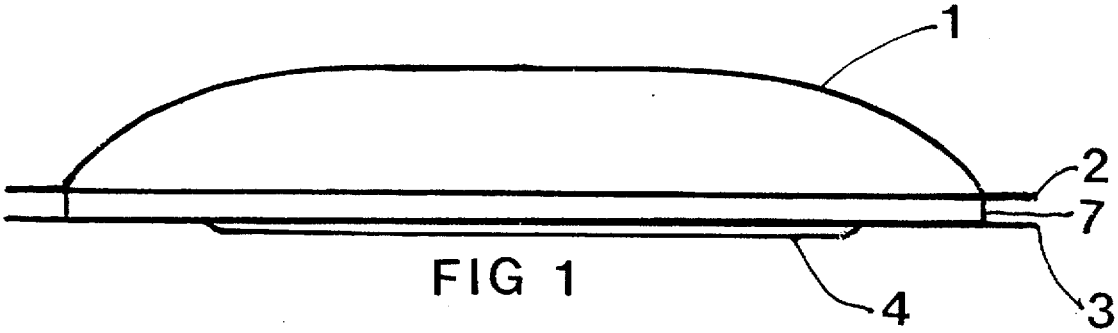
FIG. 1 shows the complete disc.

FIG. 1 shows the preferred shape of the life saving unit. The top, 1, shows the aerodynamic shape needed to make the disc fly. Number 2 indicates the upper rope retaining flange. Number 3 indicates the lower rope retaining flange. Number 4 indicates the lower side of the bottom part.

Figure 2:
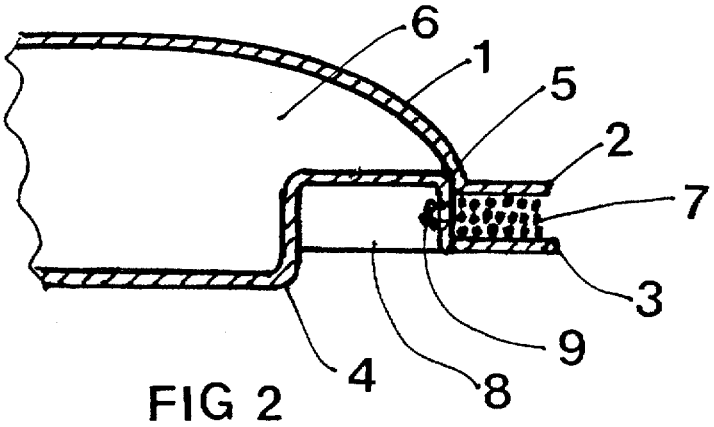
FIG. 2 shows is a sectional view of the outer rim area and the flanges.

FIG. 2 is a cross section of the outer portion of the disc. Number 1 refers to the top part. Number 2 refers to the upper flange. Number 3 refers to the lower flange. Number 4 refers to the bottom part. Number 5 refers to the seal point. Number 6 refers to floatation air chamber. Number 7 refers to the rope and the rope holding area. Number 8 refers to the recess for the fingers to grip and throw the disc.

Figure 3:
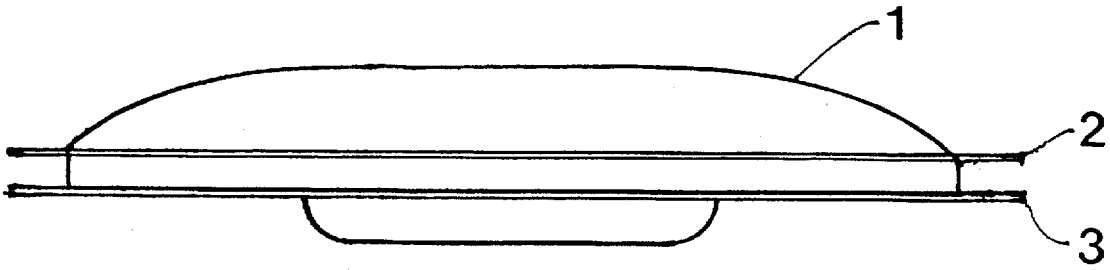
FIG. 3 shows the complete fishing disc.

FIG. 3 shows the general outline of the fishing disc. Number 1 refers to the top part. Number 2 refers to the flange on the top part. Number 3 refers to the flange on the bottom part.

Figure 4:
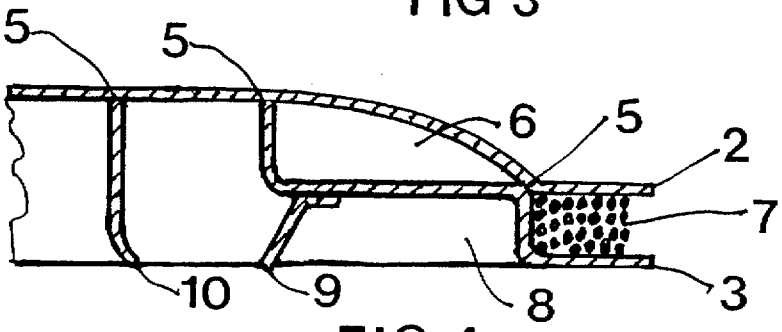
FIG. 4 shows a cross section of the fishing disc.

FIG. 4 is a cross section of one side of the fishing disc construction. Number 1 is the upper part. Number 2 is the upper flange. Number 3 is the lower flange. Number 5 is the seal points. Number 6 is the floatation chamber. Number 7 is the twine. Number 8 is the finger area. Number 9 is the inward sloping flange on the bottom part which retains the bait while the disc is spinning. Number 10 is the inner spool on which the drop line is wound.

The life saving disc, being light and large, permits the average person to throw it out, like a Frisbee®, a considerable distance with excellent accuracy. By grasping the holding loop provided at the end of the rope and dropping off one or two loops of rope, the disc can be thrown a considerable distance trailing the rope as it flies. The spinning action actually throws the rope out away from the disc. The disc has the proper aerodynamics to keep the disc relatively flat in flight so that it lands in the water upright and floats. The rope is preferably polypropelene which floats. The person overboard can grasp the disc in any manner and be pulled back to the boat or shore. The disc an be hung in a conspicuous place on the boat from where it can be grasped quickly and thrown. It will be especially valuable to sailing craft since they are difficult to turn around quickly and can get a considerable distance from the person overboard in seconds. It will also be very valuable on beaches where it is often difficult and time consuming for a life guard to swim out to one in distress. Every boat and all beaches should be equipped with the life saving disc.

The scope of this invention should be determined by the following claims and their legal equivalents.

Now that the invention has been described and understood I claim the following:

1. A throwable device which dispenses a length of line when rotatably thrown, comprising:

an aerodynamic, generally circular shaped disk, said disk being buoyant in water and having peripherally arranged flanges projecting radially outwardly from the disk for retaining a length of line, said line having a first end attached to the disk, and a second end adapted to being retained by the user, with the remainder of the line between the first and second ends being wrapped about the disk and retained by said flanges, whereby, when the disk is rotatably thrown by a person, a length of line is dispensed.

2. A throwable device which dispenses a length of line when thrown as set forth in claim 1, wherein an air chamber is provided within the disk.

* * * * *